US007361103B2

(12) United States Patent
Ladd et al.

(10) Patent No.: US 7,361,103 B2
(45) **Date of Patent: *Apr. 22, 2008**

(54) GOLF BALL WITH SMALL INNER CORE

(75) Inventors: Derek A. Ladd, Fairhaven, MA (US); Michael J. Sullivan, Barrington, RI (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/707,492

(22) Filed: Feb. 16, 2007

(65) Prior Publication Data

US 2007/0149320 A1 Jun. 28, 2007

Related U.S. Application Data

(60) Continuation of application No. 11/427,814, filed on Jun. 30, 2006, now Pat. No. 7,195,569, which is a division of application No. 11/298,170, filed on Dec. 10, 2005, now Pat. No. 7,094,160, which is a division of application No. 11/094,722, filed on Mar. 30, 2005, now Pat. No. 7,001,287, which is a division of application No. 10/335,720, filed on Jan. 2, 2003, now Pat. No. 6,916,254.

(51) Int. Cl.
*A63B 37/06* (2006.01)

(52) U.S. Cl. ..... 473/376

(58) Field of Classification Search ..... 473/376, 473/373, 374, 377

See application file for complete search history.

(56) References Cited

U.S. PATENT DOCUMENTS 4,625,964 A 12/1986 Yamada
5,048,838 A 9/1991 Chikaraishi
5,104,126 A 4/1992 Gentiluomo
5,155,157 A 10/1992 Statz et al.
5,252,652 A 10/1993 Egashira et al.
5,482,285 A 1/1996 Yabuki et al.
5,743,816 A 4/1998 Ohsumi et al.
5,772,531 A 6/1998 Ohsumi et al.
5,779,562 A 7/1998 Melvin et al.

(Continued)

FOREIGN PATENT DOCUMENTS

EP 1084736 3/2001

*Primary Examiner*—Raeann Trimiew
(74) *Attorney, Agent, or Firm*—Kristin D. Wheeler

(57) ABSTRACT

The present invention is directed to golf balls having a resilient inner core and outer core made of a material substantially free of fillers. The invention also encompasses golf balls wherein the inner and outer cores are not made of a thermoplastic material. The invention encompasses golf balls having an inner core, an outer core, an inner cover, and an outer cover wherein the inner core is encased by an outer core wherein the outer core has a volume greater than the inner core, inner cover, or outer cover and the inner core is made of a material substantially free of fillers. The volume relationship of the inner core ($V_{12}$), outer core ($V_{14}$), inner cover ($V_{16}$), and outer cover ($V_{18}$) is represented by the mathematical relationship: $V_{14}>\frac{3}{5}(V_{12}+V_{16}+V_{18})$, wherein $V_{12}\geqq V_{18}\geqq V_{16}$. Also, the inner core has a specific gravity $\rho_{12}$, the outer core has a specific gravity $\rho_{14}$, the inner cover has a specific gravity $\rho_{16}$, and the outer cover has a specific gravity $\rho_{18}$, wherein the relationship between the specific gravities is expressed by the mathematical expression: $\rho_{16}\geqq\rho_{18}\geqq\rho_{12}\geqq\rho_{14}$.

20 Claims, 1 Drawing Sheet

U.S. PATENT DOCUMENTS 6,057,403 A 5/2000 Sullivan et al.
6,083,119 A * 7/2000 Sullivan et al. ..... 473/354
6,117,025 A 9/2000 Sullivan
6,120,393 A 9/2000 Sullivan
6,142,887 A 11/2000 Sullivan
6,152,834 A 11/2000 Sullivan
6,213,895 B1 4/2001 Sullivan et al.
6,245,859 B1 6/2001 Sullivan et al.
6,299,550 B1 10/2001 Molitor et al.
6,309,314 B1 10/2001 Sullivan et al.
6,336,872 B1 1/2002 Moriyama et al.
6,361,454 B1 3/2002 Yoshida et al.
6,379,269 B1 4/2002 Nesbitt et al.
6,394,914 B1 5/2002 Sullivan
6,495,633 B1 12/2002 Sullivan et al.
6,547,677 B2 4/2003 Sullivan et al.
6,548,618 B2 4/2003 Sullivan et al.
6,572,493 B2 6/2003 Ohama
6,585,608 B2 7/2003 Sullivan et al.
6,612,941 B2 9/2003 Kennedy et al.
6,676,540 B2 1/2004 Ohama
6,849,006 B2 2/2005 Cavallaro et al.
6,916,254 B2 * 7/2005 Ladd et al. ..... 473/376
7,001,287 B2 * 2/2006 Ladd et al. ..... 473/376
7,094,160 B2 * 8/2006 Ladd et al. ..... 473/376
7,195,569 B2 * 3/2007 Ladd et al. ..... 473/376
2002/0045696 A1 4/2002 Sullivan et al.
2002/0055399 A1 5/2002 Kato

* cited by examiner

GOLF BALL WITH SMALL INNER CORE

CROSS REFERENCE TO RELATED APPLICATIONS

This application is a continuation of U.S. patent application Ser. No. 11/427,814, filed on Jun. 30, 2006, now U.S. Pat. No. 7,195,569 which is a divisional of U.S. patent application Ser. No. 11/298,170, filed on Dec. 10, 2005, now U.S. Pat. No. 7,094,160, which is a divisional of U.S. patent application Ser. No. 11/094,722, filed on Mar. 30, 2005, now U.S. Pat. No. 7,001,287, which is a divisional of U.S. patent application Ser. No. 10/335,720, filed on Jan. 2, 2003, now U.S. Pat. No. 6,916,254, which are incorporated by reference herein in their entirety.

FIELD OF THE INVENTION

This invention generally relates to golf balls and more particularly, the invention is directed to golf balls having a low spin and a high rotational momentum imparted by a soft interior inner core and at least one weight shifted outer layer.

BACKGROUND OF THE INVENTION

Conventional golf balls have primarily two functional components: the inner core and the cover. The primary purpose of the inner core is to be the "spring" of the ball or the principal source of resiliency, and the inner core may be either solid or wound. The primary purpose of the cover is to protect the inner core. Multi-layer solid balls include multi-layer inner core constructions, multi-layer cover constructions, or combinations thereof. In a golf ball with a multi-layer inner core, the principal source of resiliency is the multi-layer inner core. In a golf ball with a multi-layer cover, the principal source of resiliency is the single-layer inner core.

Two-layer solid balls are made with a single-solid inner core, typically a cross-linked polybutadiene or other rubber, encased by a hard cover material. Increasing the cross-link density of the inner core material can increase the resiliency of the inner core. As the resiliency increases, however, the compression may also increase making the ball stiffer, thereby increasing driver spin rates. In an effort to make golf balls with improved performance characteristics, manufacturers have used thermoplastics in various layers in multi-layer golf balls. Some thermoplastic materials have a low flexural modulus, such that layers formed therefrom produce golf balls with driver spin rates at higher than desirable levels. Such high spin rates, although allowing a more skilled player to maximize control of the golf ball, can also cause golf balls to have severely parabolic trajectories and do not achieve sufficient distance. Thus, manufacturers often try to strike a balance between spin rate and distance. By adding fillers in thermoplastic layers, the flexural modulus or stiffness of such layers increases, so that the golf balls produced have lower spin rates and can achieve greater distances. However, a need still exists for a golf ball with a filled thermoplastic layer that strike a balance between high flexural modulus (for lower driver spin) and the amount of fillers required to achieve such modulus.

The spin rate of golf balls is the end result of many variables, one of which is the distribution of the density or specific gravity within the ball. Spin rate is an important characteristic of golf balls for both skilled and recreational golfers. High spin rate allows the more skilled players, such as PGA professionals and low handicapped players, to maximize control of the golf ball. A high spin rate golf ball is advantageous for an approach shot to the green. The ability to produce and control back spin to stop the ball on the green and side spin to draw or fade the ball substantially improves a player's control over the ball. Hence, the more skilled players generally prefer a golf ball that exhibits high spin rate, in part, off scoring irons, such as the 7-iron club through the pitching wedge.

On the other hand, the recreational players who cannot intentionally control the spin of the ball generally do not prefer a high spin rate golf ball. For these players, slicing and hooking the ball are the more immediate obstacles. When a club head strikes a ball improperly, an unintentional side spin is often imparted to the ball, which sends the ball off its intended course. The side spin reduces a player's control over the ball, as well as the direct-line distance the ball will travel. A golf ball that spins less tends not to drift off-line erratically if the ball is not hit squarely with the club face. A low spin ball will not cure the hook or slice, but will reduce the adverse effects of the side spin. Hence, recreational players typically prefer a golf ball that exhibits low spin rate.

Varying materials or reallocating the density or specific gravity of the various layers of a golf ball provides an important means of controlling the spin rate. In some instances, the weight from the outer portions of the ball is redistributed toward the center to decrease the moment of inertia, thereby increasing the spin rate. For example, U.S. Pat. No. 4,625,964 discloses a golf ball with a reduced moment of inertia having an inner core with specific gravity of at least 1.50 and a diameter of less than 32 mm and an intermediate layer of lower specific gravity between the inner core and the cover. U.S. Pat. No. 5,104,126 discloses a ball with a dense inner core having a specific gravity of at least 1.25 encapsulated by a lower density syntactic foam composition. U.S. Pat. No. 5,048,838 discloses another golf ball with a dense inner core having a diameter in the range of 15-25 mm with a specific gravity of 1.2 to 4.0 and an outer layer with a specific gravity of 0.1 to 3.0 less than the specific gravity of the inner core. U.S. Pat. No. 5,482,285 discloses another golf ball with reduced moment of inertia by reducing the specific gravity of an outer inner core to 0.2 to 1.0.

In other instances, the weight from the inner portion of the ball is redistributed outward to increase the moment of inertia, thereby decreasing the spin rate. U.S. Pat. No. 6,120,393 discloses a golf ball with a hollow inner layer with one or more resilient outer layers, thereby giving the ball a soft inner core, and a hard cover. U.S. Pat. No. 6,142,887 discloses an increased moment of inertia golf ball comprising one or more layer layers made from metals, ceramic or composite materials, and a polymeric spherical substrate disposed inwardly from the layer layers.

The redistribution of weight within the golf ball is typically accomplished by adding fillers to the inner core or to an outer layer of the golf ball. Conventional fillers include the high specific gravity fillers, such as metal or metal alloy powders, metal oxide, metal searates, particulates, carbonaceous materials, or low specific gravity fillers, such as hollow spheres, microspheres or foamed particles. However, the addition of fillers may adversely interfere with the inherent resiliency of the polymers used in golf balls and thereby the coefficient of restitution of the golf balls. Hence, there remains a need in the art for a golf ball with controlled moment of inertia that has low spin with a soft inner core substantially free from fillers.

SUMMARY OF THE INVENTION

The invention is directed to golf balls having a resilient inner core and outer core made of a material substantially free of fillers.

These and other objects of the present invention are realized by golf balls comprising an inner core, an outer core, an inner cover, and an outer cover wherein the inner core is encased by an outer core wherein the outer core has a volume greater than the inner core, inner cover, or outer cover and the inner core is made of a material substantially free of fillers.

In another embodiment of the invention, the volume relationship of the inner core ($V_{12}$), outer core ($V_{14}$), inner cover ($V_{16}$), and outer cover ($V_{18}$) is represented by the mathematical relationship: $V_{14}>\frac{3}{5}(V_{12}+V_{16}+V_{18})$, wherein $V_{12}\geqq V_{18}\geqq V_{16}$. In yet another embodiment, the inner core has a specific gravity $\rho_{12}$, the outer core has a specific gravity $\rho_{14}$, the inner cover has a specific gravity $\rho_{16}$, and the outer cover has a specific gravity $\rho_{18}$, wherein the relationship between the specific gravities is expressed by the mathematical expression: $\rho_{16}\geqq\rho_{18}\geqq\rho_{12}\geqq\rho_{14}$.

In another embodiment of the invention, the diameter of the inner core is preferably in the range of about 1.35 inches to about 0.75 inch, more preferably, in the range of about 1.25 inches to about 0.85 inch. The inner core or outer core is preferably made of polybutadiene, a crosslinker, a co-crosslinker, and preferably, a halogenated organo-sulfur compound. More preferably, the halogenated organo-sulfur compound is pentachlorothiolphenol (PCTP), ZnPCTP, or a combination thereof.

In another embodiment of the invention, the outer core preferably has a diameter in the range of about 1.65 inches to about 1.50 inches; more preferably, the outer core has a diameter in the range of about 1.62 inches to about 1.55 inches. The inner cover has a thickness of about 0.020 inch or less, more preferably about 0.015 inch or less. The inner cover has a specific gravity greater than about 2 and is made of a thermoplastic material. In another embodiment, the inner cover is made of a non-ionomeric polymer.

In yet another embodiment, the golf ball according to the invention has an outer cover with a thickness of about 0.035 inch or less.

BRIEF DESCRIPTION OF THE DRAWINGS

In the accompanying drawings, which form a part of the specification and are to be read in conjunction therewith and in which like reference numerals are used to indicate like parts in the various views.

DETAILED DESCRIPTION OF THE PREFERRED EMBODIMENTS

Figure 1:
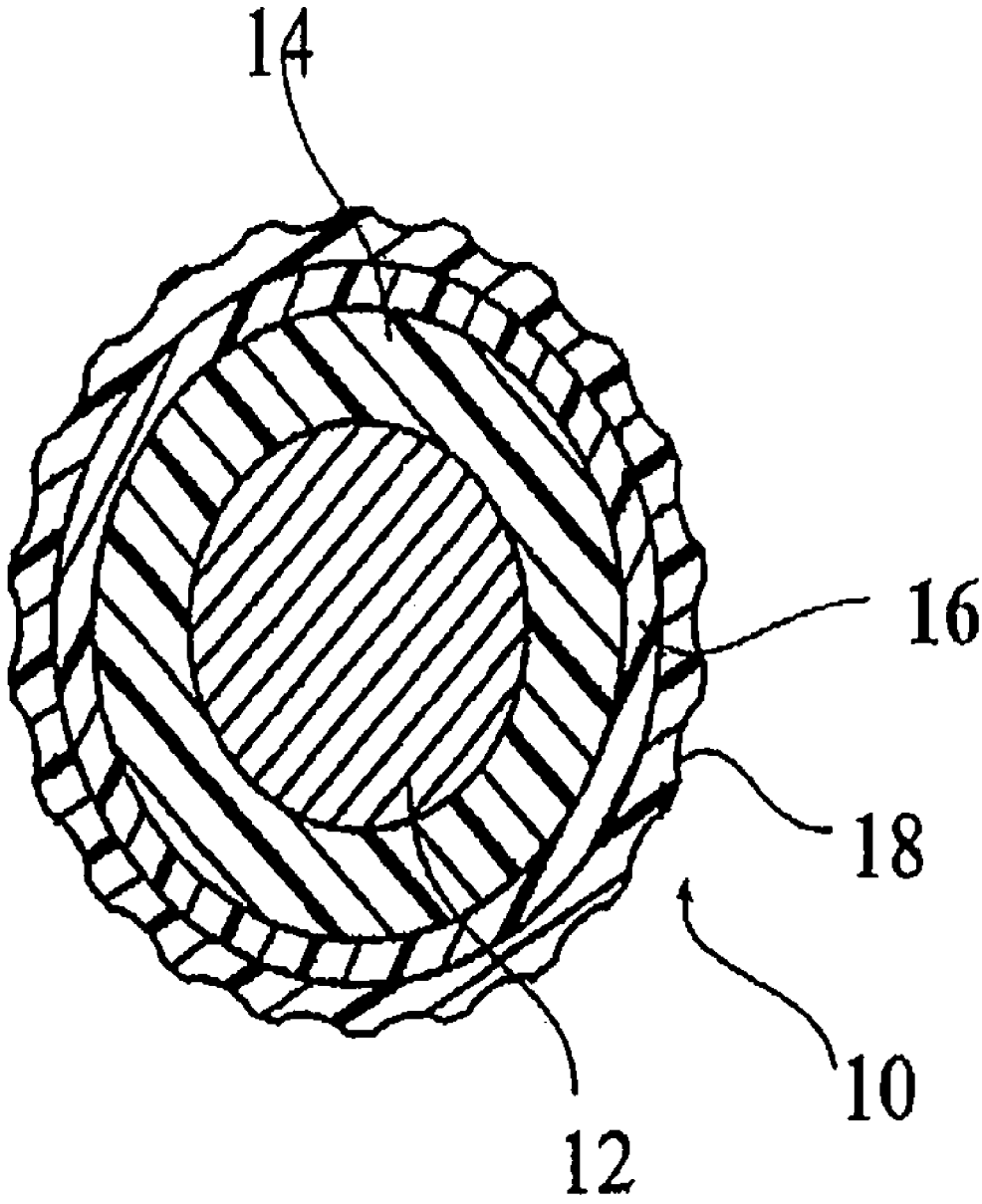
FIG. 1 is a cross-sectional view of a golf ball in accordance with the present invention.

It is well known that the total weight of the ball has to conform to the weight limit set by the United States Golf Association ("USGA"). Redistributing the weight or mass of the ball either toward the center of the ball or toward the outer surface of the ball changes the dynamic characteristics of the ball at impact and in flight. Specifically, if the density is shifted or redistributed toward the center of the ball, the moment of inertia is reduced, and the initial spin rate of the ball as it leaves the golf club would increase due to lower resistance from the ball's moment of inertia. Conversely, if the density is shifted or redistributed toward or within the outer cover, the moment of inertia is increased, and the initial spin rate of the ball as it leaves the golf club would decrease due to the higher resistance from the ball's moment of inertia. The radial distance from the center of the ball or from the outer cover, where moment of inertia switches from being increased and to being decreased as a result of the redistribution of weight or mass density, is an important factor in golf ball design.

The golf ball of the present invention addresses the problems of the prior golf balls by providing an inner core substantially without fillers, an outer core, an inner cover, and an outer cover or exterior cover wherein the ball weight is shifted towards the cover layers thereby providing a low spin golf ball. The present invention encompasses a golf ball with a high volume outer core and thin inner cover and outer cover layers able to adjust flexural modulus to accommodate spin characteristics. In particular, the present invention encompasses a golf ball wherein the outer core has a large volume, i.e. a volume greater than either the inner core, inner cover, or outer cover. Also, the invention encompasses a golf ball with a thin high density inner cover to inhibit ball spin.

Referring to FIG. 1, golf ball 10 includes an inner core 12 made from a polymer substantially free of fillers, surrounded by three layers, an outer core, an inner cover, and an outer cover. Inner core 12 may have any dimension or composition, such as thermoset rubber, thermoplastic, metal, or any material known to one skilled in the art of golf ball manufacture. Inner core 12 can be a solid inner core, a molded or wound inner core with a solid or fluid-filled center, as known by those of ordinary skill in the art.

Preferably, the inner core 12 comprises a resilient polymer such as polybutadiene, natural rubber, polyisoprene, styrene-butadiene, ethylene-propylene-diene rubber, highly neutralized polymers, or a combination thereof. More preferably, the inner core 12 comprises polybutadiene, a crosslinking agent, a co-crosslinking agent, and a halogenated organo-sulfur compound.

The inner core in accordance to the present invention preferably has a deformation zone that is substantially free of fillers. In other words, the inner core has the highest possible content of polymeric materials and more preferably the highest content of polybutadiene rubber. As used herein, the term "substantially free of fillers" means that the filler content is no more than about 5 phr to about 100 phr of rubber either before or after the cross-linking or curing process. The upper limit of filler content accounts for the impurities inherent in the materials that make up the inner core composition. For example, for an inner core composition that contains zinc acrylate or zinc diacrylate, a small amount of zinc oxide is added to the composition as an activator. Zinc oxide also reacts with and neutralizes any free acrylic acid that may be present in the zinc acrylate or zinc diacrylate to form zinc acrylate or zinc diacrylate. The zinc acrylate or zinc diacrylate is believed to become a part of the polymeric structure after the cross-linking process. The un-reacted zinc oxide remains in the inner core, present as an impurity introduced during manufacture. Hence, inner core deformation zones that have less than about 5 phr filler to about 100 phr of rubber are within the scope of the present invention. More preferably, the inner core deformation zones have less than about 3 phr of filler to about 100 phr rubber.

In one preferred embodiment, the inner core 12 is made from a polybutadiene rubber (PBD) that has a mid Mooney viscosity range greater than about 40, more preferably in the range from about 40 to about 80 and more preferably in the range from about 40 to about 60 Mooney. Polybutadiene rubber with higher Mooney viscosity may also be used, so long as the viscosity of the PBD does not reach a level where the high viscosity PBD clogs or otherwise adversely interferes with the manufacturing machinery. It is contemplated that PBD with viscosity less than 65 Mooney can be used with the present invention. A "Mooney" unit is a unit used to measure the plasticity of raw or unvulcanized rubber. The plasticity in a "Mooney" unit is equal to the torque, measured on an arbitrary scale, on a disk in a vessel that contains rubber at a temperature of 100° C. and rotates at two revolutions per minute. The measurement of Mooney viscosity is defined according to ASTM D-1646.

Golf ball inner cores made with mid to high Mooney viscosity PBD material exhibit increased resiliency, hence distance, without increasing the hardness of the ball. Such inner cores are soft, i.e., compression less than about 60 and more specifically in the range of about 50-55, and when these soft inner cores are incorporated into golf balls such inner cores generate very low spin and long distance when struck by a driver. Inner cores with compression in the range of from about 30 about 50 are also within the range of this preferred embodiment.

Commercial sources of suitable mid to high Mooney PBD include Bayer AG. "CB 23", which has a Mooney viscosity of about 51 and is a highly linear polybutadiene, is a preferred PBD. If desired, the polybutadiene can also be mixed with other elastomers known in the art, such as natural rubber, styrene butadiene, and/or isoprene in order to further modify the properties of the inner core. When a mixture of elastomers is used, the amounts of other constituents in the inner core composition are typically based on 100 parts by weight of the total elastomer mixture.

Other suitable inner core materials including thermoset plastics, such as natural rubber, other grades of polybutadiene, polyisoprene, styrene-butadiene or styrene-propylene-diene rubber, and thermoplastics such as ionomer resins, polyamides, polyesters, or a thermoplastic elastomer. Suitable thermoplastic elastomers include Pebax®, which is believed to comprise polyether amide copolymers, Hytrel®, which is believed to comprise polyether ester copolymers, thermoplastic urethane, and Kraton®, which is believed to comprise styrenic block copolymers elastomers. These products are commercially available from Elf-Atochem, E.I. Du Pont de Nemours and Company, various manufacturers, and Shell Chemical Company, respectively. The inner core materials can also be formed from a metal salt of a fatty acid, any partially or fully neutralized ionomer, a metallocene or other catalyzed polymer and a castable material. Suitable castable materials include those comprising a urethane, polyurea, epoxy, silicone, IPN's, etc. Golf ball inner cores made with these inner core materials has a PGA compression of preferably less than 90, more preferably less than 80 and most preferably less than 70.

Additionally, other suitable inner core materials are disclosed in U.S. Pat. No. 5,919,100 and international publications WO 00/23519 and WO 01/29129. These disclosures are incorporated by reference herein in their entireties. One particularly suitable material disclosed in WO/29129 is a melt processible composition comprising a highly neutralized ethylene copolymer and one or more aliphatic, monofunctional organic acids having fewer than 36 carbon atoms of salts thereof, wherein greater than 90% of all the acid of the ethylene copolymer is neutralized.

In accordance to another aspect of the invention, the halogenated organo-sulfur compounds include organic compounds wherein at least one sulfur compound is added to the material that makes up the inner core to further increase the resiliency and the coefficient of restitution of the ball. Preferred sulfur compounds include, but are not limited to, pentachlorothiophenol (PCTP) and a salt of PCTP. A preferred salt of PCTP is ZnPCTP. The utilization of PCTP and ZnPCTP in golf ball inner cores to produce soft and fast inner cores is disclosed in co-pending U.S. application Ser. No. 09/951,963 filed on Sep. 13, 2001, and is assigned to the same assignee as the present invention. This co-pending application is incorporated by reference herein, in its entirety. A suitable PCTP is sold by the Structol Company under the tradename A95. ZnPCTP is commercially available from EchinaChem.

Crosslinkers and co-crosslinkers of the present invention crosslink the polymeric material or materials used to form the inner core. Crosslinkers and co-crosslinkers used in the present invention include those commonly known to the ordinary skilled artisan. The skilled artisan can easily determine with little or no experimentation the amount of crosslinker and/or co-crosslinker necessary to achieve the desired polymeric material having the properties described above. Co-crosslinking agents may include any material named as a crosslinking agent as described above. Preferably, the crosslinking agents include metal salts of an alpha, beta-unsaturated carboxylic acid, preferably zinc diacrylate. These materials described above may be combined with other components, such as other polymers or copolymers, however not fillers, as known by one of ordinary skill in the art. The base composition can be mixed and formed using conventional techniques to produce the inner core 12. Any inner core or cover materials disclosed in the parent applications U.S. application Ser. Nos. 09/815,753, filed on Mar. 23, 2001 and 09/842,574, filed on Apr. 26, 2001 can be used with the present invention. The disclosures of these applications are incorporated by reference in their entireties.

Free radical initiators are used to promote cross-linking of the polymeric materials, in particular metal salt diacrylate, dimethacrylate, or monomethacrylate and the polybutadiene. Suitable free radical initiators for use in the invention include, but are not limited to peroxide compounds, such as dicumyl peroxide, 1,1-di(t-butylperoxy) 3,3,5-trimethyl cyclohexane, a-a bis(t-butylperoxy)diisopropylbenzene, 2,5-dimethyl-2,5 di(t-butylperoxy)hexane, or di-t-butyl peroxide, and mixtures thereof. Other useful initiators would be readily apparent to one of ordinary skill in the art without any need for experimentation. The initiator(s) at about 40% to about 100% activity are preferably added in an amount ranging between about 0.05 pph and about 5 pph based upon 100 parts of polybutadiene, or polybutadiene mixed with one or more other elastomers. More preferably, the amount of initiator added ranges between about 0.15 pph to about 2 pph and most preferably between about 0.25 pph to about 1.5 pph. Suitable commercially available dicumyl peroxides include Perkadox BC, which is a 90% active dicumyl peroxide, and DCP 70, which is a 70% active dicumyl peroxide.

Preferably, the diameter of the inner core 12 is in the range of about 1.350 inches to about 0.750 inch. More preferably, the diameter of the inner core is in the range of about 1.250 inches to about 0.850 inch.

The inner core 12 is preferably surrounded by three layers, i.e. the outer core 14, the inner cover 16, and the outer cover or exterior cover layer 18. The outer core 14 is made from materials similar to those described above for the inner core. In particular, the outer core 14 is substantially free of fillers and preferably, made of polybutadiene, a crosslinking agent, a co-crosslinking agent and a halogenated organo-sulfur compound. Preferably, the density of outer core 14 is less than the density of inner core 12.

Preferably, the outer core is the thickest layer and has the largest volume of the inner core or the covers. Preferably, the diameter of the outer core 14 is in the range of about 1.650 inches to about 1.580 inches. More preferably, the diameter of the outer core 14 is in the range of about 1.620 inches to about 1.550 inches. Preferably, the outer core 14 has a volume ($V_{14}$) greater than the volume of the inner core ($V_{12}$), the volume of the inner cover ($V_{16}$), or the volume of the outer cover ($V_{18}$) and a density lower than the density of the cover or other cover layers. More preferably, the volume occupied by the outer core is greater than 3/5 of the total volume of the inner core and remaining cover layers. Mathematically, the volume relationship can be expressed as $V_{14}>3/5(V_{12}+V_{16}+V_{18})$, wherein $V_{12}\geqq V_{18}\geqq V_{16}$. The relationship of the inner core and layers may also be expressed in terms of specific gravity ($\rho$). The inner cover has the highest specific gravity ($\rho_{16}$) whereas the outer core has the lowest specific gravity ($\rho_{14}$). Mathematically, the specific gravity relationship between the inner core and cover layers can be expressed as follows: $\rho_{16}\geqq\rho_{18}\geqq\rho_{12}\geqq\rho_{14}$.

To craft a high moment of inertia ball, the inner cover 16 may have high density fillers, such as those described below incorporated therein so long as the cover layer is thin. In other words, the inner cover 16 is a thin inner cover. Preferably, the inner cover is the densest portion of the golf ball. The inner cover 16 is made preferably from thermoplastic materials as described below. More preferably, the material is a non-ionomeric polymer. Suitable thermoplastic materials for the inner cover include polyethylene, polystyrene, polypropylene, thermoplastic polyesters, acetal, polyamides including semicrystalline polyamide, polycarbonate (PC), shape memory polymers, polyvinyl chloride (PVC), trans-polybutadiene, liquid crystalline polymers, polyether ketone (PEEK), bio(maleimide), and polysulfone resins. Other preferred thermoplastics for forming the inner cover include other Surlyn® from DuPont and, single-site catalyzed polymers including non-metallocene and metallocene, polyurethane, polyurea, or a combination of the foregoing. Suitable polymeric materials also include those listed in U.S. Pat. Nos. 6,187,864, 6,232,400, 6,245,862, 6,290,611 and 6,142,887 and in PCT publication No. WO 01/29129, which are incorporated herein by reference in their entirety. Suitable materials are also disclosed in an U.S. Patent Application entitled "Golf Ball with Vapor Barrier Layer," bearing application Ser. No. 10/077,081, filed on Feb. 15, 2002. The disclosures of this application are incorporated by reference herein in its entirety.

The inner cover preferably has a thickness of less than about 0.020 inch, more preferably less than about 0.015 inch. Preferably, the inner cover layer has a specific gravity of more than about 2.0. Preferably, inner cover 16 is located as close as possible to the outer surface of the ball. The advantages of locating the inner cover as radially outward as possible have been discussed in detail above.

Except for the moment of inertia, the presence of the inner cover preferably does not appreciably affect the overall ball properties, such as the feel, compression, coefficient of restitution, and cover hardness. Suitable materials for the inner cover include any material that meets the specific gravity and thickness conditions stated above. The inner cover is preferably applied to the inner core as a liquid solution, dispersion, lacquer, paste, gel, melt, etc., such as a loaded or filled natural or non-natural rubber latex, polyurethane, polyurea, epoxy, polyester, any reactive or non-reactive coating or casting material, and then cured, dried or evaporated down to the equilibrium solids level. The inner cover may also be formed by compression or injection molding, RIM, casting, spraying, dipping, powder coating, or any means of depositing materials onto the inner core. The inner cover may also be a thermoplastic polymer loaded with a specific gravity increasing filler, fiber, flake or particulate, such that it can be applied as a thin coating and meets the preferred specific gravity levels discussed above.

For reactive liquid systems, the suitable materials include any material which reacts to form a solid such as epoxies, styrenated polyesters, polyurethanes or polyureas, liquid PBR's, silicones, silicate gels, agar gels, etc. Casting, RIM, dipping and spraying are the preferred methods of applying a reactive inner cover. Non-reactive materials include any combination of a polymer either in melt or flowable form, powder, dissolved or dispersed in a volatile solvent. Suitable thermoplastics are disclosed in U.S. Pat. Nos. 6,149,535 and 6,152,834.

Alternatively, the inner cover may be a loaded thin film or "pre-preg" or a "densified loaded film," as described in U.S. Pat. No. 6,010,411 ("the '411 patent") related to golf clubs, may be used as the thin film layer in a compression molded or otherwise in a laminated form applied inside the outer cover. The "pre-preg" disclosed in the '411 patent may be used with or without the fiber reinforcement, so long as the preferred specific gravity and preferred thickness levels are satisfied. The loaded film comprises a staged resin film that has a densifier or weighing agent, preferably copper, iron or tungsten powder evenly distributed therein. The resin may be partially cured such that the loaded film forms a malleable sheet that may be cut to desired size and then applied to the outside of the inner core or inside of the cover. Such films are available from the Cytec of Anaheim, Calif. or Bryte of San Jose, Calif.

The inner cover layer 16 of the present invention is preferably formed from a hard, high flexural modulus, resilient material that contributes to the low spin, distance characteristics of the presently claimed balls when they are struck for long shots (e.g. driver or long irons). Specifically, the inner cover layer materials have a Shore D hardness of greater than about 65, more preferably about 65-80, and most preferably about 70-75. Furthermore, as defined herein, the term "high flexural modulus" means a flexural modulus (as measured by ASTM D-6272-98, entitled "Standard Test Method for Flexural Properties of Unreinforced and Reinforced Plastics and Electrical Insulating Materials by Four Point Bending") of at least about 60,000 psi, preferably about 70,000 psi to about 120,000 psi and most preferably at least about 75,000 psi.

The inner cover layer may also be formed from thermoplastic polymer with low flexural modulus that can be reinforced by fillers. As used herein, the term "fillers" includes any compound or composition that can be used to vary the density and other properties of the subject golf ball inner cover and/or outer cover or exterior cover. Fillers useful in the golf ball layer according to the present invention include, but are not limited to, metal (or metal alloy) powders, metal oxide, metal searates, particulate, carbonaceous materials, and the like or blends thereof. The amount and type of fillers utilized is governed by the amount and weight of other ingredients in the composition, since a maximum golf ball weight of 1.620 ounces (45.92 gm) has been established by the USGA.

Examples of useful metal (or metal alloy) powders include, but are not limited to, bismuth powder, boron powder, brass powder, bronze powder, cobalt powder, copper powder, inconel metal powder, iron metal powder, molybdenum powder, nickel powder, stainless steel powder, titanium metal powder, zirconium oxide powder, aluminum flakes, tungsten metal powder, beryllium metal powder, zinc metal powder, or tin metal powder. Examples of metal oxides include, but are not limited to, zinc oxide, iron oxide, aluminum oxide, titanium dioxide, magnesium oxide, zirconium oxide, and tungsten trioxide. Examples of particulate carbonaceous materials include, but are not limited to, graphite and carbon black. Examples of other useful fillers include, but are not limited to, graphite fibers, precipitated hydrated silica, clay, talc, glass fibers, aramid fibers, mica, calcium metasilicate, barium sulfate, zinc sulfide, silicates, diatomaceous earth, calcium carbonate, magnesium carbonate, regrind (which is recycled uncured polymeric material mixed and ground to 30 mesh particle size), manganese powder, magnesium powder, and mixtures thereof.

Fillers can have specific gravity of greater than 2.0 and can be as high as 20.0, and can also increase the rotational moment of inertia of the ball. As discussed in U.S. patent application Ser. Nos. 09/815,753 and 09/842,574, the high rotational moment of inertia reduces the driver spin rate of the golf ball.

Suitable thermoplastic matrix materials include those that have low flexural modulus, in the range of about 500 psi and about 30,000 psi, relatively low resilience and high spin. Advantageously, fillers increase the flexural modulus, as well as the hardness of inner cover 16. Moreover, adding fillers to a thermoplastic polymer increases its flexural modulus, and makes the thermoplastic suitable for use in an outer layer of the golf ball. For example, polyethylene methacrylic acid resins or other non-ionomers, which have desirable properties such as low water vapor transmission rate and high melt flow index, can be improved by incorporating fillers therein to increase its flexural modulus and hardness without unnecessarily increase spin, as shown in the test results discussed below. Another advantage is that the inner cover can be made very thin, preferably less than about 0.020 inch, so that a very large outer core 14 can be employed. A large outer core is desirable, because it is the principal source of resilience and coefficient of restitution of the golf ball.

Suitable low flexural modulus, relatively low resilience, and high spin thermoplastics include, but are not limited to, thermoplastic urethanes and polyethylene methacrylic acid resins commercially available as Nucrel® from DuPont. Additional suitable thermoplastics include copolymers of ethylene and methacrylic acid having an acid level from about 3% to about 25% by weight. More preferably, the acid level ranges from about 4% to about 15%, and most preferably from about 7% to about 11%. Copolymers of ethylene and methacrylic acid have an advantage in that these compounds typically have high melt flow index. Other suitable thermoplastics include copolymers of ethylene and a carboxylic acid, or terpolymers of ethylene, a softening acrylate class ester such as methyl acrylate, n-butyl-acrylate or iso-butyl-acrylate, and carboxylic acids. Exemplary carboxylic acids are acrylic acid, methacrylic acid or maleic acid. Exemplary softening acrylate class esters are methyl acrylate, n-butyl-acrylate or iso-butyl-acrylate. Examples of such terpolymers include polyethylene-methacrylic acid-n or iso-butyl acrylate and polyethylene-acrylic acid-methyl acrylate, polyethylene ethyl or methyl acrylate, polyethylene vinyl acetate, polyethylene glycidyl alkyl acrylates. A benefit of using these thermoplastics is that a very thin layer with low water vapor transmission rate can be obtained. The benefits of higher melt flow index include easier extrusion, higher extrusion rate, higher flow during heat sealing, and the ability to make thin cover layers or thin films. Without limiting the present invention to any particular theory, materials with relatively high melt flow index have relatively low viscosity. Low viscosity helps the materials spread evenly and thinly to produce a thin film.

Other suitable low flexural modulus thermoplastics include "very low modulus acid copolymer ionomer" or VLMI, wherein the copolymer contains about 10% by weight of acid and 10-90% of the acid is neutralized by sodium, zinc or lithium ions. The VLMI has flexural modulus of about 2,000 to 8,000 psi. Suitable VLMIs include Surlyn® 8320 (Na), Surlyn® 9320 (Zn) and Surlyn® 8120 (Na). These VLMIs and high crystalline ionomers are described in U.S. Pat. No. 6,197,884.

The inner cover matrix material can also be formed of at least one ionomer, ionomer blends, non-ionomers or non-ionomer blends. For example, the matrix can include highly neutralized polymers as disclosed in WO 01/29129 incorporated by reference herein in its entirety. The matrix can also be formed of combinations of the above-described matrix materials, including terpolymers of ethylene, methyl acrylate and acrylic acid (EMAAA), commercially available under the tradename Escor® Acid Terpolymers from Exxon Mobile Chemical.

The specific formulations of the inner cover and outer cover materials may include additives, other fillers, inhibitors, catalysts and accelerators, and cure systems depending on the desired performance characteristics.

The fillers and/or the matrix can be optionally surface treated with a suitable coupling agent, bonding agent or binder. This coupling agent improves the adhesion between the fillers and the polymeric matrix and reduces the number of voids present in the matrix material. A void is an undesirable air pocket in the matrix that does not support the fillers. Unsupported fillers under a load may buckle and transfer the stresses to the matrix, which could crack the matrix. The coupling agents can be functional monomers, oligomers and polymers. The functional groups include, but are not limited to, maleic anhydride, maleimide, epoxy, hydroxy amine, silane, titanates, zirconates, and aluminates.

In another embodiment the inner and outer cover layers are disclosed in U.S. Pat. No. 5,885,172, which is incorporated herein by reference in its entirety. The outer cover layer 18 is preferably formed from a relatively soft thermoset material in order to replicate the soft feel and high spin play characteristics of a balata ball when the balls of the present invention are used for pitch and other "short game" shots. In particular, the outer cover layer should have a Shore D hardness of from less than about 65 or about 30 to about 60, preferably about 35 to about 50 and most preferably about 40 to about 45. Hardness is preferably measured pursuant to ASTM D-2240-02a (entitled "Standard Test Method for Rubber Property—Durometer Hardness") in either button or slab form. Additionally, the materials of the outer cover layer should have a degree of abrasion resistance in order to be suitable for use as a golf ball cover.

The outer cover 18 or exterior cover layer can also be made of materials commonly known to the skilled artisan. The materials may include polymers known to the skilled artisan. Preferably, the material includes polyurethane, polyurea, or a combination thereof. Exterior cover layer 18 is preferably formed with a plurality of dimples or surface protrusions defined on the outer surface thereof. The polymer forming the outer cover layer 18 may include fillers embedded in a polymeric matrix or binder material. Preferably, the thickness of the outer cover layer is less than 0.035 inch.

Conventionally, thermoset polyurethanes are prepared using a diisocyanate, such as 2,4-toluene diisocyanate (TDI) or methylenebis-(4-cyclohexyl isocyanate) (HMDI) and a polyol which is cured with a polyamine, such as methylenedianiline (MDA), or a trifunctional glycol, such as trimethylol propane, or tetrafunctional glycol, such as N,N,N',N'-tetrakis(2-hydroxpropyl)ethylenediamine. However, the present invention is not limited to just these specific types of thermoset polyurethanes. Quite to the contrary, any suitable thermoset polyurethane may be employed to form the outer cover layer of the present invention.

When described above, compression is measured by applying a spring-loaded force to the golf ball center, golf ball inner core or the golf ball to be examined, with a manual instrument (an "Atti gauge") manufactured by the Atti Engineering Company of Union City, N.J. This machine, equipped with a Federal Dial Gauge, Model D81-C, employs a calibrated spring under a known load. The sphere to be tested is forced a distance of 0.2 inch (5 mm) against this spring. If the spring, in turn, compresses 0.2 inch, the compression is rated at 100; if the spring compresses 0.1 inch, the compression value is rated as 0. Thus more compressible, softer materials will have lower Atti gauge values than harder, less compressible materials. Compression measured with this instrument is also referred to as PGA compression. The approximate relationship that exists between Atti or PGA compression and Riehle compression can be expressed as:

(Atti or PGA compression)=(160−Riehle Compression).

While it is apparent that the illustrative embodiments of the invention disclosed herein fulfill the objectives stated above, it is appreciated that numerous modifications and other embodiments may be devised by those skilled in the art. Therefore, it will be understood that the appended claims are intended to cover all such modifications and embodiments, which would come within the spirit and scope of the present invention.

What is claimed is:

1. A golf ball comprising an inner core, an outer core, an inner cover, and an outer cover wherein the inner core is encased by an outer core wherein the outer core has a volume greater than the inner core, inner cover, or outer cover, and the outer core is comprised of a highly neutralized polymer, is substantially free of fillers, and the diameter of the inner core is in the range of about 1.35inch to about 0.75inch, wherein the inner core has a specific gravity $\rho_{12}$, the outer core has a specific gravity $\rho_{14}$, the inner cover has a specific gravity $\rho_{16}$, and the outer cover has a specific gravity $\rho_{18}$, wherein the relationship between the specific gravities is expressed by the mathematical expression: $\rho_{16} \geqq \rho_{18} \geqq \rho_{12} \geqq \rho_{14}$, and wherein at least one of the inner cover and outer covet comprises a thermoplastic material.

2. The golf ball according to claim 1, wherein the thermoplastic material comprises at least one material selected from the group consisting of an ionomer, ionomer blends, non-ionomer and non-ionomer blends.

3. The golf ball according to claim 1, wherein the thermoplastic material comprises polyurethane.

4. The golf ball according to claim 1, wherein the thermoplastic material comprises polyurea.

5. The golf ball according to claim 1, wherein the inner cover layer has a Shore D hardness of greater than about 65.

6. The golf ball according to claim 1, wherein the inner cover layer comprises a flexural modulus of greater than about 60,000psi.

7. The golf ball according to claim 1, wherein the outer cover layer has a Shore D hardness of from about 30to about 60.

8. The golf ball according to claim 1, wherein the inner cover has a thickness of less than about 0.020 inch.

9. The golf ball according to claim 1, wherein the inner cover has a specific gravity greater than about 2.

10. The golf ball according to claim 1, wherein the outer cover has a thickness of about 0.035 inch or less.

11. A golf ball comprising an inner core, an outer core, an inner cover, and an outer cover wherein the inner core is encased by an outer core wherein the outer core has a volume greater than the inner core, inner cover, or outer cover, and the inner core is comprised of a highly neutralized polymer, is substantially free of fillers, and the outer core is comprised of a highly neutralized polymer, wherein the inner core has a specific gravity $\rho_{12}$, the outer core has a specific gravity $\rho_{14}$, the inner cover has a specific gravity $\rho_{16}$, and the outer cover has a specific gravity $\rho_{18}$, wherein the relationship between the specific gravities is expressed by the mathematical expression: $\rho_{16} \geqq \rho_{18} \geqq \rho_{12} \geqq \rho_{14}$, and wherein at least one of the inner cover and outer cover comprises a thermoplastic material.

12. The golf ball according to claim 1, wherein the thermoplastic material comprises at least one material selected from the group consisting of an ionomer, ionomer blends, non-ionomer and non-ionomer blends.

13. The golf ball according to claim 11, wherein the thermoplastic material comprises polyurethane.

14. The golf ball according to claim 11, wherein the thermoplastic material comprises polyurea.

15. The golf ball according to claim 11, wherein the inner cover layer has a Shore D hardness of greater than about 65.

16. The golf ball according to claim 11, wherein the inner cover layer comprises a flexural modulus of greater than about 60,000 psi.

17. The golf ball according to claim 11, wherein the outer cover layer has a Shore D hardness of from about 30 to about 60.

18. The golf ball according to claim 11, wherein the inner cover has a thickness of less than about 0.020 inch.

19. The golf ball according to claim 11, wherein the inner cover has a specific gravity greater than about 2.

20. The golf ball according to claim 11, wherein the outer cover has a thickness of about 0.035 inch or less.

* * * * *